US007581652B2

(12) United States Patent
Flak, Jr. et al.

(10) Patent No.: US 7,581,652 B2
(45) Date of Patent: Sep. 1, 2009

(54) TAMPER-INDICATING PACKAGE, AND A CLOSURE AND CONTAINER FOR SUCH A PACKAGE

(75) Inventors: Frank Flak, Jr., Ada, OH (US); James L. Gregory, Maumee, OH (US); Ramsey J. Haylett, Perrysburg, OH (US); Thomas A. Kozlowski, Perrysburg, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 722 days.

(21) Appl. No.: 11/199,623

(22) Filed: Aug. 9, 2005

(65) Prior Publication Data

US 2007/0034591 A1 Feb. 15, 2007

(51) Int. Cl.
*B65D 51/00* (2006.01)
*B65B 7/28* (2006.01)
*B65D 53/00* (2006.01)

(52) U.S. Cl. ..... 215/252; 215/43; 215/44; 215/45; 215/321

(58) Field of Classification Search ..... 215/43, 215/252, 341, 44, 45
See application file for complete search history.

(56) References Cited

U.S. PATENT DOCUMENTS

| | | | | |
|---|---|---|---|---|
| 111,607 | A | | 2/1871 | Bissell |
| 3,504,818 | A | | 4/1970 | Crisci et al. |
| 3,874,540 | A | | 4/1975 | Hidding |
| 4,413,743 | A | | 11/1983 | Summers |
| 4,534,480 | A | | 8/1985 | Santostasi et al. |
| 4,609,115 | A | * | 9/1986 | Moore et al. ..... 215/252 |
| 4,830,207 | A | | 5/1989 | Battegazzore |
| 5,009,323 | A | | 4/1991 | Montgomery et al. |
| 5,040,692 | A | | 8/1991 | Julian |
| 5,056,675 | A | | 10/1991 | Julian |
| 5,115,932 | A | | 5/1992 | Schneider |
| 5,190,178 | A | | 3/1993 | Luch |
| 5,213,224 | A | | 5/1993 | Luch |

(Continued)

FOREIGN PATENT DOCUMENTS

EP 1114781 A2 7/2001

(Continued)

OTHER PUBLICATIONS

"Hood Carb" Container and Closure Photos.

(Continued)

*Primary Examiner*—Robin Hylton
(74) *Attorney, Agent, or Firm*—Reising Ethington PC

(57) ABSTRACT

A tamper-indicating closure includes a plastic shell having a base wall with an annular skirt, at least one internal thread segment on the skirt, a tamper band frangibly connected to the skirt, and a circumferential array of angularly spaced flexible resilient ratchet wings extending counterclockwise from an inner surface of the tamper band at an angle to the inner surface. A flexible resilient sealing liner on the base wall within the skirt has a conical sealing surface that faces radially outwardly toward the skirt and axially away from the base wall. The conical sealing surface is resiliently engageable with a trim flange of a container to which the closure is applicable so that the tamper band separates from the annular skirt before loss of sealing engagement between the liner and the trim flange.

5 Claims, 5 Drawing Sheets

U.S. PATENT DOCUMENTS

| | | | | |
|---|---|---|---|---|
| 5,346,082 | A | 9/1994 | Ochs et al. | |
| 5,456,376 | A | 10/1995 | Luch et al. | |
| 5,593,055 | A | 1/1997 | Repp et al. | |
| 5,687,866 | A | 11/1997 | Luch et al. | |
| 5,755,348 | A | 5/1998 | Luch et al. | |
| 5,975,321 | A | 11/1999 | Luch | |
| 6,003,701 | A | 12/1999 | Hidding et al. | |
| 6,173,853 | B1 | 1/2001 | Luch | |
| 6,523,710 | B1 * | 2/2003 | Hidding et al. | 215/252 |
| 6,533,136 | B1 | 3/2003 | Willingham | |
| 6,637,611 | B2 | 10/2003 | Luch | |
| 6,692,685 | B1 | 2/2004 | Willingham | |
| 6,696,123 | B2 * | 2/2004 | Hock et al. | 428/36.6 |
| 6,823,651 | B2 | 11/2004 | Thierjung et al. | |
| 7,021,478 | B1 * | 4/2006 | Hock | 215/349 |
| 2001/0000602 | A1 | 5/2001 | Luch | |
| 2005/0199574 | A1 | 9/2005 | Bloom et al. | |
| 2005/0252878 | A1 | 11/2005 | Babcock | |

FOREIGN PATENT DOCUMENTS

| | | |
|---|---|---|
| JP | 08164960 | 6/1996 |
| JP | 08282694 | 10/1996 |

OTHER PUBLICATIONS

Notification of Transmittal of the International Preliminary Report on Patentability based on PCT/US2006/034060 mailed Sep. 9, 2008.
"Hood Carb" Container and Closure Photos, taken Jul. 25, 2005.

* cited by examiner

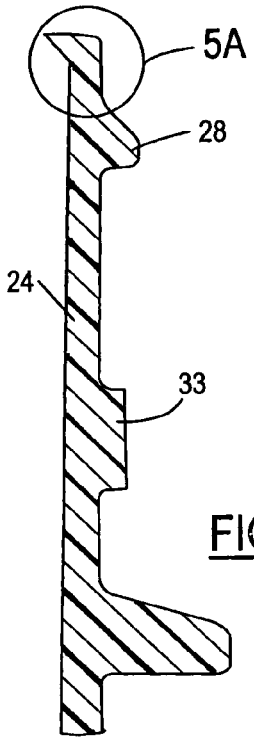
FIG. 5
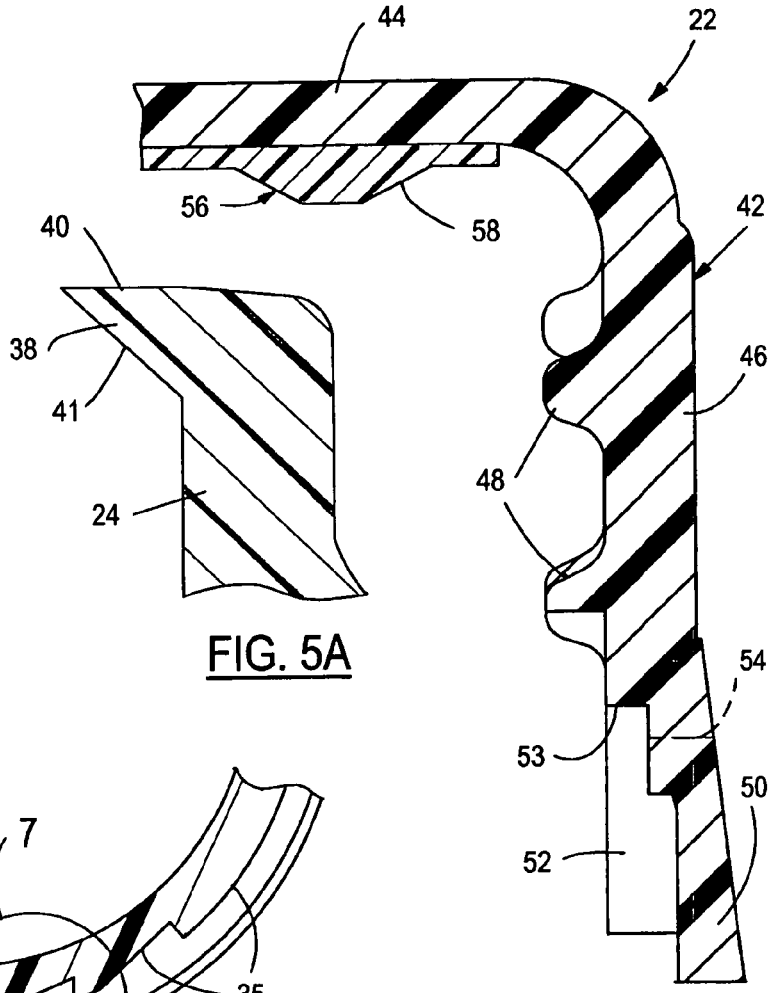
FIG. 5A
FIG.8
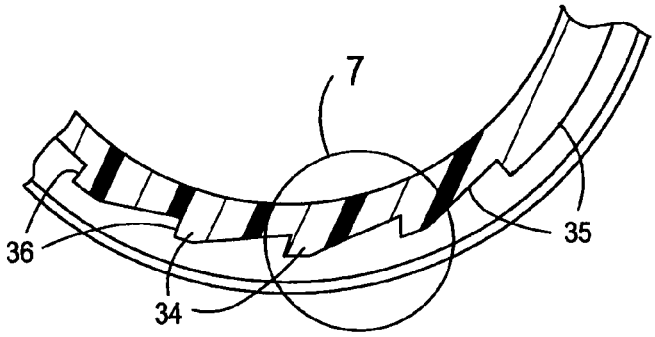
FIG.6
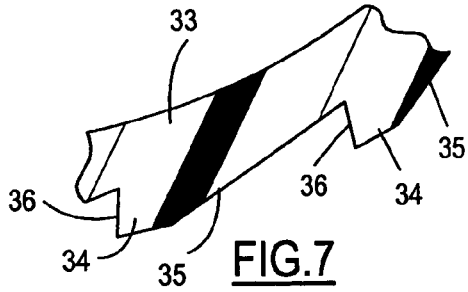
FIG.7
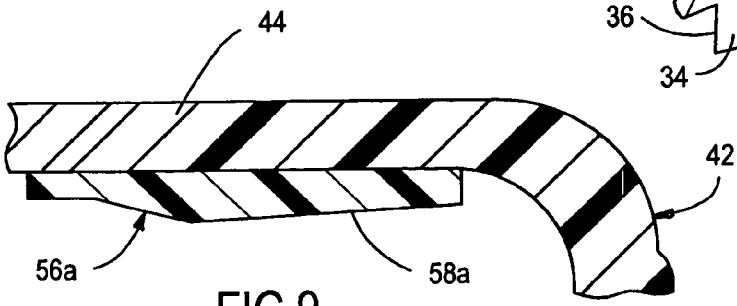
FIG.9

TAMPER-INDICATING PACKAGE, AND A CLOSURE AND CONTAINER FOR SUCH A PACKAGE

The present disclosure is directed to a tamper-indicating package, and to a closure and container for such a package, in which the closure and container are constructed such that the tamper-indicating mechanism is activated before loss of sealing engagement between the closure and the container neck finish.

BACKGROUND AND SUMMARY OF THE DISCLOSURE

Many aseptic-fill packages, such as packages for dairy products, are provided with a foil seal over the end of the container neck finish before the closure is applied to the neck finish. This foil seal functions both to seal the package during shipment, storage and handling, and to provide indication that the package has been opened when the foil seal has been ruptured or removed. However, there is a desire to eliminate the cost associated with provision of this foil seal and the inconvenience of requiring removal of the foil seal by the consumer. The present disclosure is directed to a tamper-indicating package, and to a closure and a container for such a package, in which the closure and the container are constructed such that a tamper-indicating mechanism on the closure is activated before loss of sealing engagement between the closure and the container neck finish.

The present disclosure embodies a number of aspects that can be implemented separately from or in combination with each other.

A tamper-indicating package in accordance with one aspect of the present disclosure includes a container having a neck finish with an open end, at least one external thread segment, and first and second sets of angularly spaced ratchet teeth in diametrically opposed arrays spaced from the open end of the neck finish. A closure has a base wall with an annular skirt and at least one internal thread segment on the skirt for engagement with the external thread segment on the container neck finish to secure the closure to the container. A circumferential array of angularly spaced flexible resilient ratchet wings extend counterclockwise from an inner surface of the tamper band at an angle to such inner surface. A flexible resilient sealing liner is provided on the base wall within the skirt, and has an annular surface that faces radially outwardly toward the skirt and axially away from the base wall. The ratchet wings are resiliently flexed by the ratchet teeth radially outwardly toward the tamper band during clockwise application of the closure to the container neck finish, and abut clockwise-oriented abutment faces on the ratchet teeth to resist counterclockwise unthreading of the closure from the neck finish so that removal of the closure from the neck finish frangibly separates the tamper band from the skirt. Resilient engagement of the liner surface with the open end of the container neck finish is such that the tamper band is separated from the skirt before loss of sealing engagement between the liner and the open end of the neck finish.

The open end of the neck finish preferably has a radially inwardly extending trim flange, which may be flexible, resilient and deformed axially inwardly by engagement with the liner surface. Resilient engagement of the liner surface with the trim flange is such that the tamper band is separated from the skirt before loss of sealing engagement between the liner and the trim flange. The ratchet wings preferably extend from an inside surface of the tamper band onto an inside surface of the closure skirt and frangibly connect the tamper band to the skirt. Each ratchet tooth of each set on the container neck finish preferably is diametrically opposed to an associated ratchet tooth of the opposing set, such that all ratchet teeth are simultaneously engaged by ratchet wings on the closure skirt. The flexible resilient liner preferably includes barrier material resistant to migration of gases, water vapor and/or flavorants through the liner.

BRIEF DESCRIPTION OF THE DRAWINGS

The disclosure, together with additional objects, features, advantages and aspects thereof, will best be understood from the following description, the appended claims and the accompanying drawings, in which:

FIG. 5 is a fragmentary sectional view taken substantially along the line 5-5 in FIG. 4;

FIG. 5A is a fragmentary sectional view of the portion of FIG. 5 within the area 5A;

FIG. 6 is a fragmentary sectional view of the portion of FIG. 4 within the area 6;

FIG. 7 is a fragmentary sectional view on an enlarged scale of the portion of FIG. 6 within the area 7;

FIG. 8 is a fragmentary sectional view of the closure in the package of FIGS. 1 and 2;

FIG. 9 is a fragmentary sectional view of a closure in accordance with another exemplary embodiment of the disclosure;

DETAILED DESCRIPTION OF PREFERRED EMBODIMENTS

The disclosure of U.S. Pat. No. 6,533,136 is incorporated herein by reference.

Figure 1:
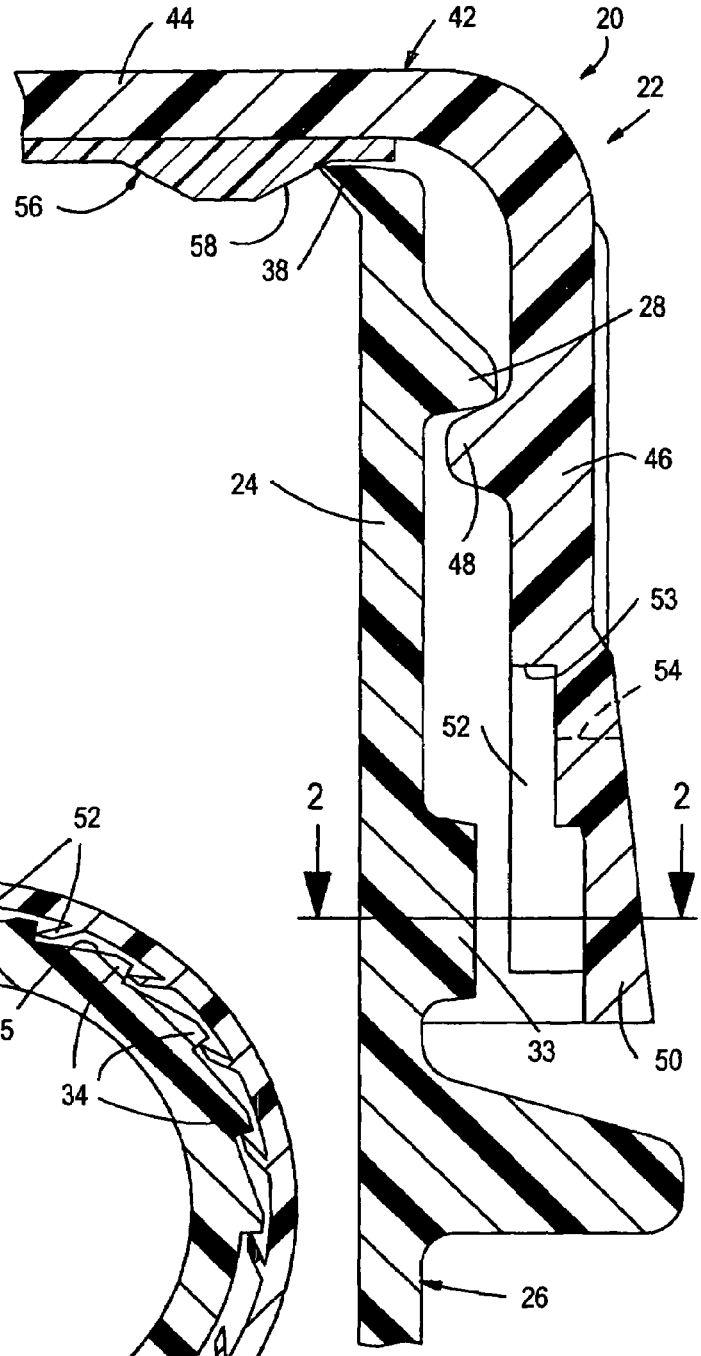
FIG. 1 is a fragmentary sectional view of a tamper-indicating package in accordance with an exemplary embodiment of the present disclosure.
Figure 2:
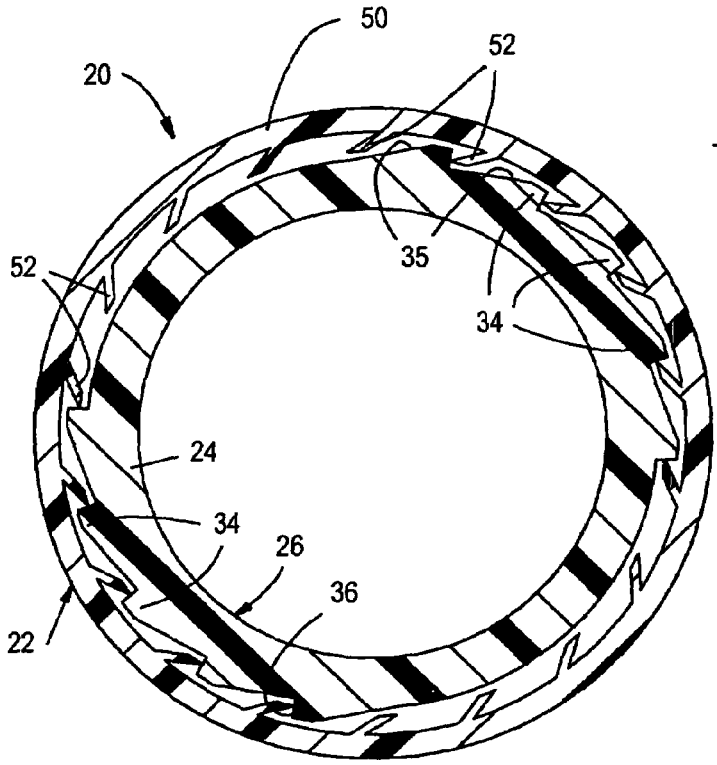
FIG. 2 is a sectional view taken substantially along the line 2-2 of FIG. 1.
Figure 4:
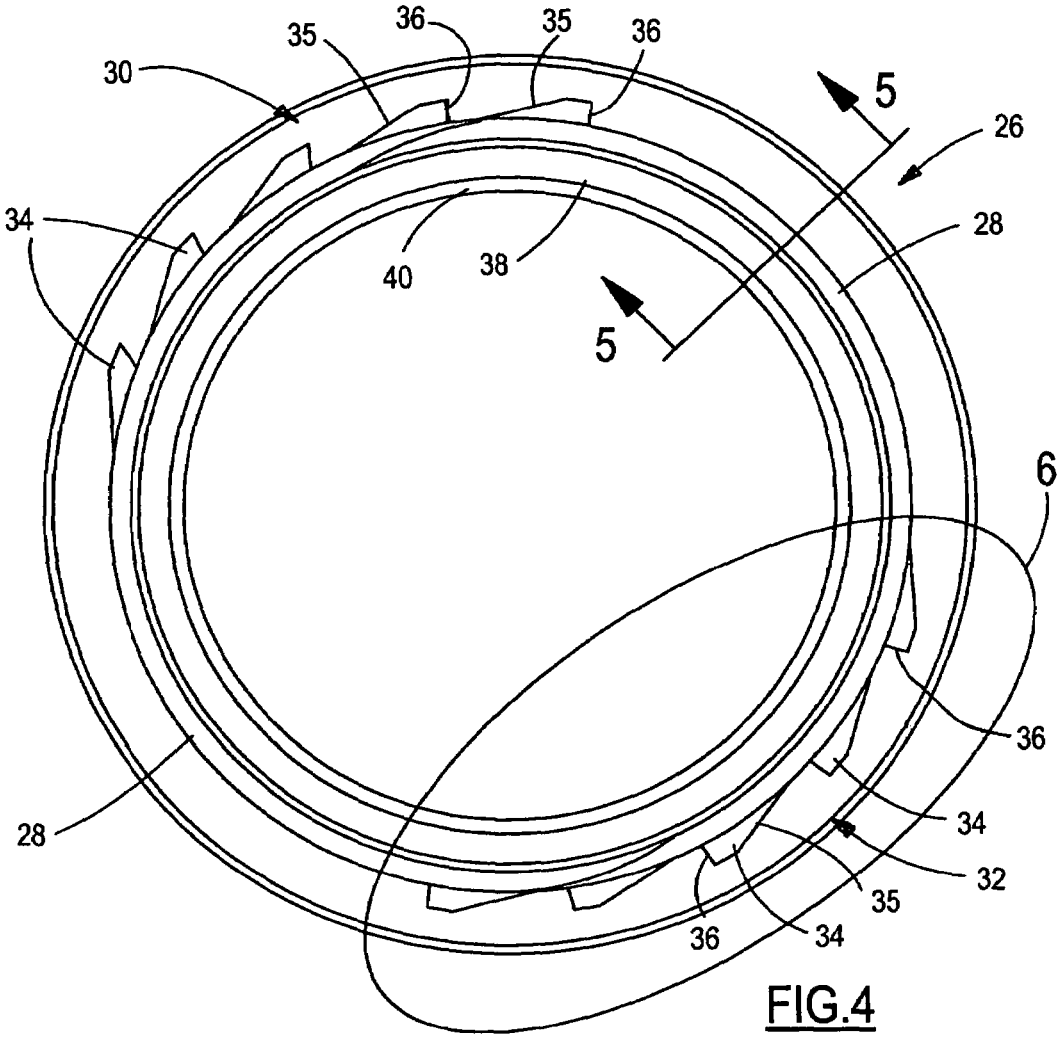
FIG. 4 is a top plan view of the container illustrated in FIG. 3.
Figure 3:
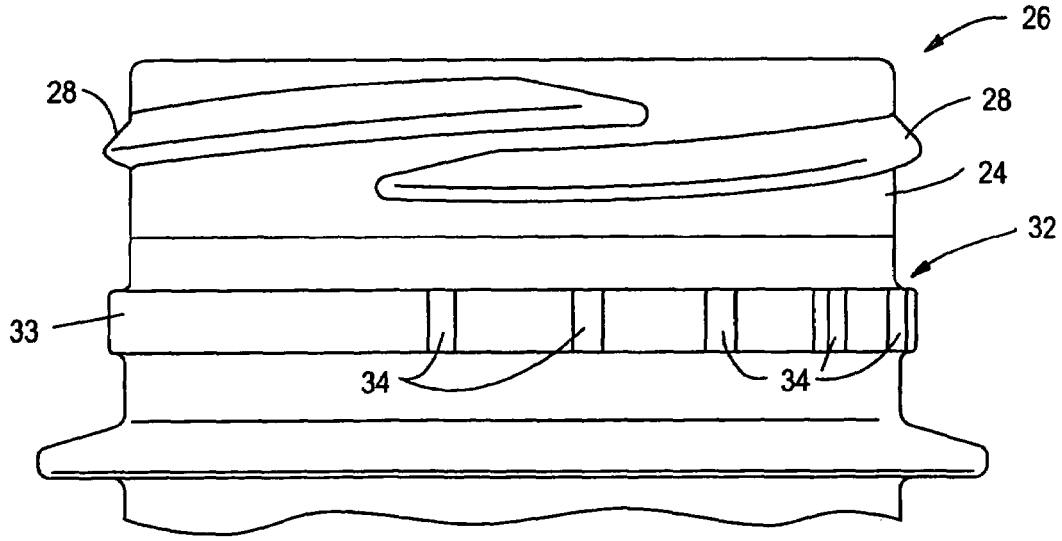
FIG. 3 is a fragmentary elevational view of the container in the package of FIGS. 1 and 2.
Figure 10:
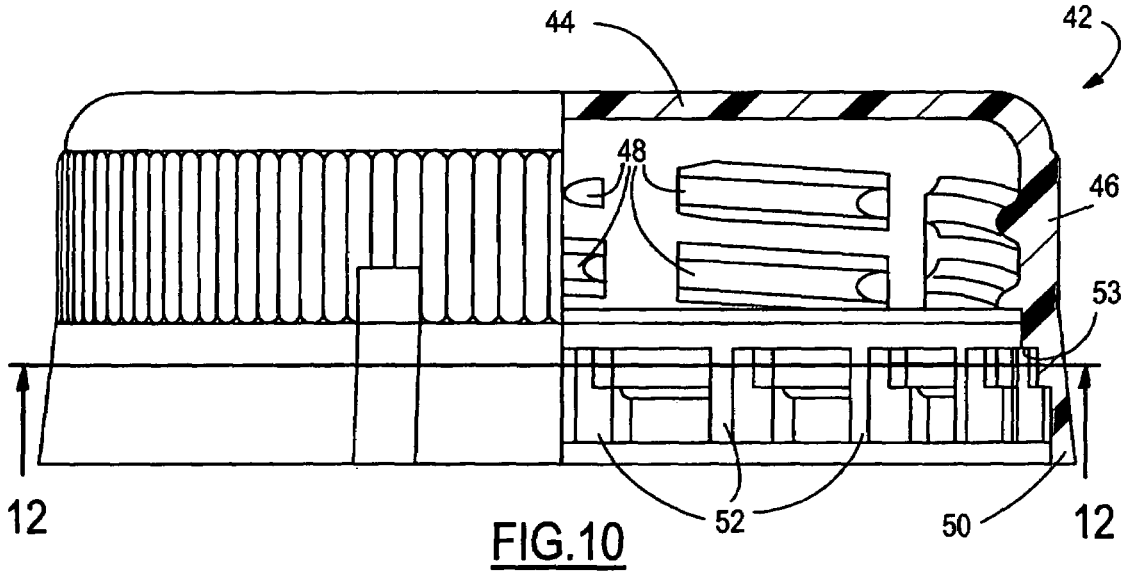
FIG. 10 is a partially sectioned elevational view of the shell in the closure of FIG. 8.
Figure 11:
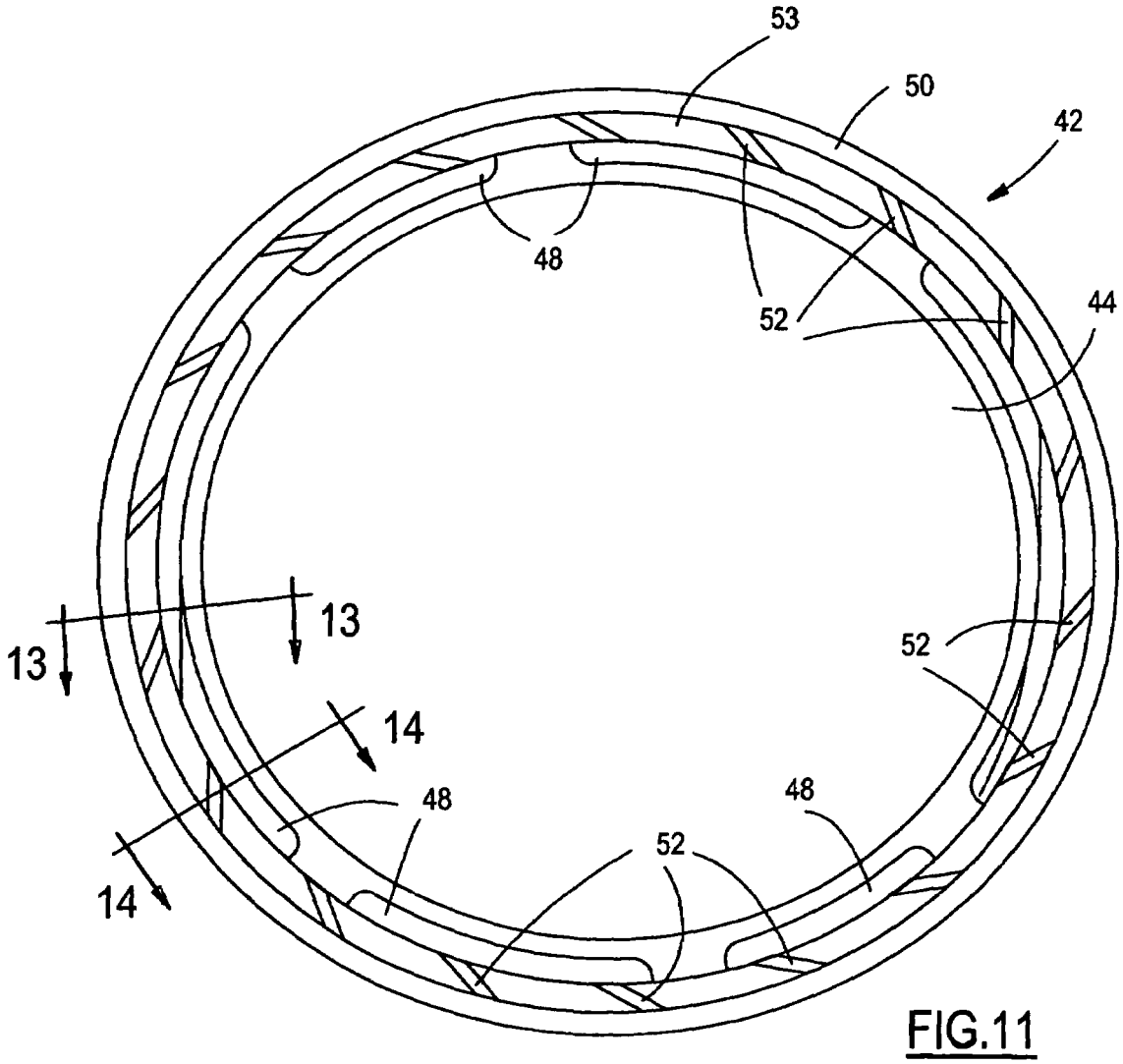
FIG. 11 is a bottom plan view of the closure shell in FIG. 10.
Figure 12:
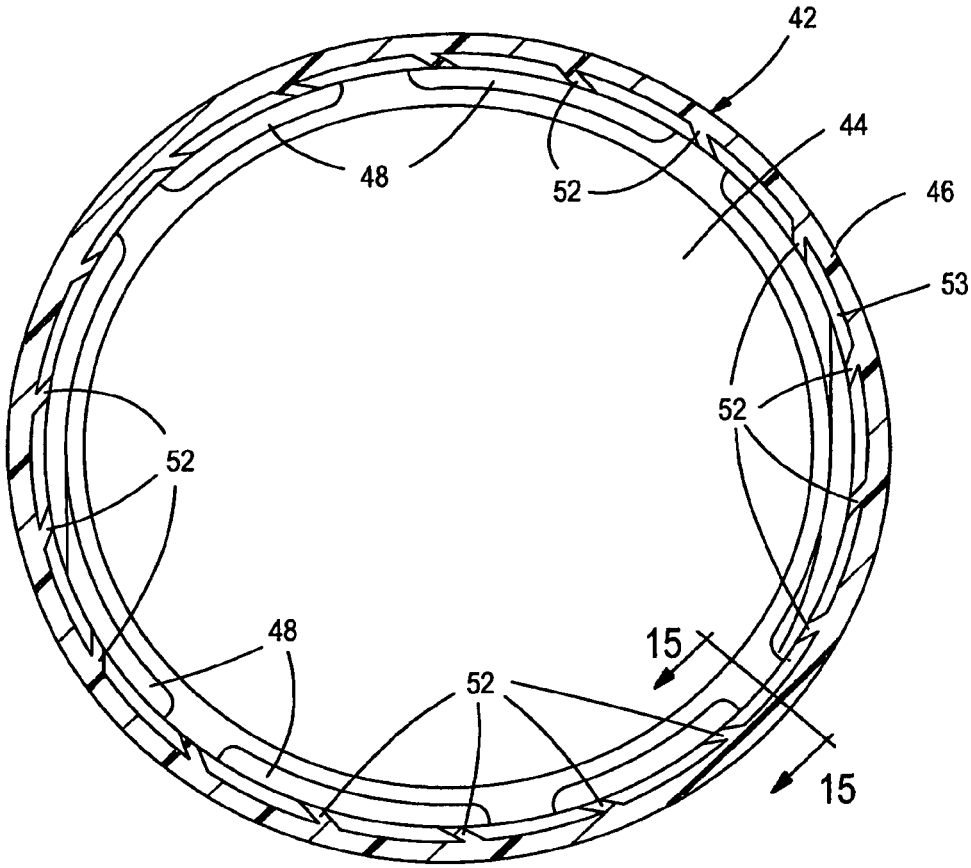
FIG. 12 is a sectional view taken substantially along the line 12-12 in FIG. 10.
Figure 13:
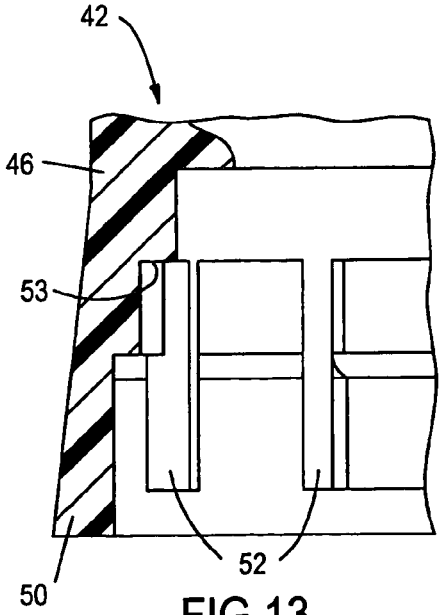
FIGS. 13 and 14 are fragmentary sectional views taken substantially along the lines 13-13 and 14-14 in FIG. 11.
Figure 14:
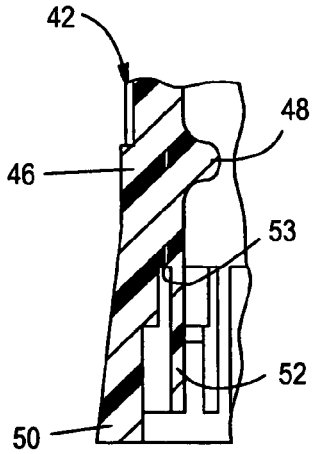
Figure 15:
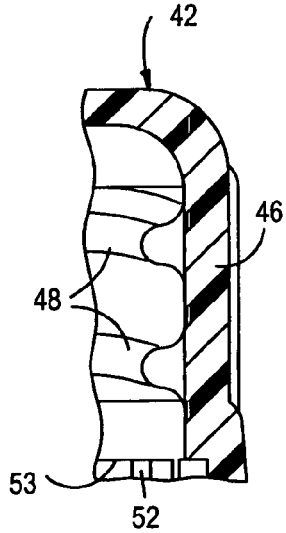
FIG. 15 is a fragmentary sectional view taken substantially along the line 15-15 in FIG. 12.

FIGS. 1-2 illustrate a package 20 in accordance with an exemplary embodiment of the present disclosure. Package 20 includes a closure 22 applied to the neck finish 24 of a container 26. Container 26 is illustrated in greater detail in FIGS. 3-7. Neck finish 24, which typically is cylindrical, has one or more external thread segments 28. First and second sets 30,32 of angularly spaced ratchet teeth 34 are in diametrically opposed arrays on neck finish 24 on a side of thread segments 28 remote from the open upper end of the neck finish. (Directional words such as "upper" and "lower" are employed by way of description and not limitation with respect to the upright orientation of the package, container and closure illustrated in FIGS. 1, 3 and 10, for example. Directional words such as "diametric" or "circumferential" are employed by way of description and not limitation with respect to the axis of the container neck finish and/or the closure skirt as appropriate. The term "thread segment" is employed in its usual broad sense to include both partial and full helical threads, and both continuous and interrupted threads.) Ratchet teeth 34 extend radially outwardly from an external ledge 33, which preferably extends entirely around the neck finish. Ledge 33 and ratchet teeth 34 may be solid, as shown, or hollow. Each ratchet tooth 34 has a counterclockwise-facing cam surface 35 and a clockwise-facing abutment surface 36. Ratchet teeth 34 may be identical, but preferably are non-identical to facilitate removal of container neck finish 24 from its forming mold.

Container 26, including neck finish 24, preferably is formed in an extrusion blow molding operation, as described for example in detail in above-referenced U.S. Pat. No. 6,533,136. During such container manufacture, a trim flange 38 is formed at the open end of the container neck finish during a post-mold trimming operation by means of a suitable knife blade or the like to separate the container neck finish from an integrally formed moil or another container. This trimming operation forms a trimmed surface 40 (FIG. 5A) on which there is no vestige caused by mold mismatch or the like during the molding operation. Trimmed surface 40, which is annular (FIG. 4) and extends around the open end of the container neck finish, may be in a plane perpendicular to the axis of the container neck finish as illustrated in FIG. 5A, or may be a conical surface that extends either upwardly or downwardly with respect to the container neck finish, particularly after the neck finish and trim flange have cooled after the trimming operation. By way of example only, trimmed surface 40 may nominally be perpendicular to the axis of the neck finish as noted, and undersurface 41 (FIG. 5A) of trim flange 38 may be at a nominal angle of 45° to the neck finish axis. Container 26 may be of any suitable material, such as a polyethylene. Depending upon the geometry of trim flange 38, the trim flange can be relatively rigid, or can be flexible and resilient.

Closure 22 is illustrated in detail in FIGS. 8 and 10-15. Closure 22 includes a one-piece shell 42 of compression molded or injection molded plastic construction, such as polypropylene for example. Shell 42 has a base wall 44 and an annular skirt 46. Skirt 46 is illustrated as extending from the periphery of base wall 44 in the exemplary embodiment of the disclosure. However, in other embodiments of the disclosure, there may be an additional skirt disposed radially outwardly of skirt 46 to match the sidewall contour of the container to which the closure will be applied. One or more internal thread segments 48 are provided on the inside surface of skirt 46. A tamper band 50 is frangibly connected to skirt 46 of closure shell 42. In shell 42 as molded (FIGS. 10-15), tamper band 50 preferably forms an integral axial extension from the end of skirt 46 remote from base wall 44. Tamper band 50 separates from skirt 46, as will be described, to indicate that the package has been opened. In the exemplary embodiment of the disclosure, this band separation is complete, in that band 50 completely separates from skirt 46. However, tamper band separation could be partial separation, as described for example in U.S. Pat. Nos. 4,432,461, 5,295,600 or 6,053,344, and still be within the scope of the present disclosure.

A circumferential array of angularly spaced flexible resilient ratchet wings 52 extend from the inner surface of tamper band 50. Ratchet wings 52 preferably are nominally flat as molded and extend counterclockwise at an angle to the inner surface of band 50 as viewed from above (or clockwise as viewed from below in FIGS. 11 and 12). Ratchet wings 52 preferably are at equal angular spacing around the inner surface of tamper band 50. In the illustrated exemplary embodiment of the disclosure, there are eighteen ratchet wings 52 at equal angular spacings of 20° around the inside surface of tamper band 50, and the abutment spaces 36 (FIGS. 4, 6 and 7) of ratchet teeth 34 preferably are at equal angular spacings of 20°. Each ratchet wing 52 preferably extends axially from the inner surface of band 50 onto the inner surface of skirt 46. As best seen in FIG. 8, skirt 46 has an internal ledge 53. Ratchet wings integrally extend along the inside surface of band 50 and skirt 46, and are integrally joined to ledge 53. Ratchet wings 52 preferably do not extend all of the way to the free edge of band 50. Skirt 46 preferably is scored along the line 54 in FIGS. 1 and 8, substantially at the location of section line 12-12 in FIG. 10, following the shell molding operation. This score extends through the integral connection of band 50 to skirt 46, so that band 50 is frangibly connected to skirt 46 by the several ratchet wings 52. Extension of ratchet wings into skirt 46 enhances the stability of the ratchet wings, and the use of the ratchet wings as the frangible connection to skirt 46 eliminates the need for separately molded leaders. As an alternative, band 50 may be separate from skirt 46 and connected to skirt 46 by ratchet wings 52 as molded.

After molding closure shell 42, and either before or after scoring along the line 54 as preferred, a liner 56 is provided on the inside or undersurface of closure base wall 44. Liner 56 is of flexible resilient construction, and may be provided on closure base wall 44 in a compression molding or other suitable liner forming operation. Liner 56 has a sealing surface 58 that faces radially outwardly toward skirt 46 and axially away from base wall 44. Surface 58 in the embodiment of FIGS. 1 and 8 is a conical surface, for example having an angle of about 62° to the axis of skirt 46. FIG. 9 illustrates another exemplary embodiment in which the sealing surface **58*a* of liner 56*a* is at an angle of about 86° to the axis of the closure skirt. Liner 56 (or 56*a*) preferably includes a barrier material resistant to migration of gases, water vapor and/or flavorants through the liner. Liner 56 (or 56*a*) may, for example, be provided in accordance with the disclosure of U.S. Pat. No. 6,371,318 or U.S. Pat. No. 6,399,170. Liner 56 or 56*a* extends along the entire undersurface of closure base used 44 within surface 58, and preferably slightly radially outward from surface 58** as shown.

Closure 22 is applied to container neck finish 24 by threading the closure onto the container neck finish in a clockwise direction as viewed from above. Ratchet wings 52 on closure 22 engage cam surfaces 35 on ratchet teeth 34, and are resiliently flexed by the ratchet teeth radially outwardly toward tamper band 50 and closure skirt 46 during such clockwise application of the closure to the neck finish. Whereas ratchet wings 52 preferably are flat as molded, and preferably are at substantially identical angles to the inside surface of tamper band 50 as molded, the ratchet wings may bend to non-flat configurations and/or to non-identical angles to the tamper band during application to the container neck finish. The axial spacings and dimensions between container thread segments 28 and ratchet teeth 34, and between closure thread segments 48 and ratchet wings 52, preferably are such that the thread segments engage each other as the closure is applied to the container before the ratchet wings engage the ratchet teeth. This helps assemble the closure onto the container in automatic capping equipment. Full application of the closure to the container neck finish brings trimmed surface 40 of neck finish trim flange 38 into opposed or abutting engagement with sealing surface 58 of liner 56 (or sealing surface **58*a* of liner 56*a* in FIG. 9). The resiliency of liner 56 is such that trim flange 38 compresses the liner. The trim flange 38 may be such that the trim flange is resiliently flexed inwardly (with respect to the container) by engagement with liner 56** during application of the closure.

When closure 22 thereafter is rotated in the counterclockwise or removal direction with respect to container neck finish 24, ratchet wings 52 are brought into engagement with abutment faces 36 of ratchet teeth 34, as illustrated in FIG. 2. A preferred equal angular spacing of abutment faces 36 and ratchet wings 52 ensures that all of the abutment faces 36 are simultaneously engaged by ratchet wings 52, as shown in FIG. 2. This simultaneous engagement facilitates rupture or frangible separation of tamper band 50 from closure skirt 46. In accordance with the present disclosure, the resiliency of liner 56 (or 56*a*) and/or trim flange 38 is such that tamper band 50 is separated from closure skirt 46 before the loss of sealing engagement between liner 56 (or 56*a*) and trim flange 38.

There thus have been disclosed a tamper-indicating package, and a closure and container for such a package, that fully satisfy all of the objects and aims previously set forth. The disclosure has been presented in connection with several exemplary embodiments, and a number of additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A tamper-indicating closure that includes a plastic shell having a base wall with an annular skirt, at least one internal thread segment on said skirt, a tamper band frangibly connected to said skirt, and a circumferential array of angularly spaced flexible resilient ratchet wings extending counterclockwise from an inner surface of said tamper band at an angle to said inner surface, and a flexible resilient sealing liner on said base wall within said skirt, said liner having a conical sealing surface that faces radially outwardly toward said skirt and axially away from said base wall and said conical sealing surface is resiliently engageable with a trim flange of a container to which said closure is applicable so that said tamper band separates from said annular skirt before loss of sealing engagement between said liner and said trim flange, wherein said ratchet wings extend from said inner surface of said tamper band onto an inner surface of said skirt and frangibly connect said band to said skirt even after said closure is applied to said container.

2. The closure set forth in claim 1 wherein said flexible resilient liner includes barrier material resistant to migration of gases, water vapor and/or flavorants through said liner.

3. A tamper-indicating package that includes:

a container having a neck finish with an open end, at least one external thread segment, and first and second sets of angularly spaced ratchet teeth in diametrically opposed arrays spaced from said open end, and a closure having a base wall with an annular skirt, at least one internal thread segment on said skirt, a tamper band frangibly connected to said skirt, and a circumferential array of angularly spaced flexible resilient ratchet wings extending counterclockwise from an inner surface of said tamper band at an angle to said inner surface, said ratchet wings being resiliently flexed by said ratchet teeth radially outwardly toward said band during clockwise application of said closure to said neck finish and abutting clockwise-oriented abutment faces of said ratchet teeth to resist counterclockwise unthreading of said closure from said neck finish so that removal of said closure from said neck finish frangibly separates said band from said skirt, said ratchet teeth of said sets being diametrically opposed to each other such that said ratchet wings engage said abutment faces of said ratchet teeth simultaneously, wherein said container neck finish has a radially inwardly extending trim flange at said open end, said closure has a flexible resilient liner on said base wall within said skirt, said liner having a conical sealing surface that faces radially outwardly toward said skirt and axially away from said base wall in resilient sealing engagement with said trim flange, said ratchet wings extend axially from said inner surface of said tamper band onto an inner surface of said skirt and frangibly connecting said tamper band to said skirt even after said closure is applied to said container, and resilient engagement of said liner surface with said trim flange is such that said tamper band is separated from said skirt before loss of sealing engagement between said liner and said trim flange.

4. The package set forth in claim 3 wherein said flexible resilient liner includes barrier material resistant to migration of gases, water vapor and/or flavorants through said liner.

5. The package set forth in claim 3 wherein axial spacings between said external thread segments and said ratchet teeth on said neck finish, and between said internal thread segment and said ratchet wings on said closure, are such that said thread segments engage each other as said closure is applied to said container before said ratchet wings engage said ratchet teeth.

* * * * *

UNITED STATES PATENT AND TRADEMARK OFFICE

CERTIFICATE OF CORRECTION

PATENT NO. : 7,581,652 B2
APPLICATION NO. : 11/199623
DATED : September 1, 2009
INVENTOR(S) : Flak, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1057 days.

Signed and Sealed this

Fourteenth Day of September, 2010

David J. Kappos

David J. Kappos
*Director of the United States Patent and Trademark Office*